US006524166B1

(12) United States Patent
Bergquist et al.

(10) Patent No.: US 6,524,166 B1
(45) Date of Patent: Feb. 25, 2003

(54) GRINDING TOOL FOR GRINDING BUTTONS OF A ROCK DRILL BIT, A GRINDING CUP, A GRINDING SPINDLE AND METHOD FOR MOUNTING THE GRINDING CUP ON A GRINDING SPINDLE

(75) Inventors: Arne Bergquist, Sandviken (SE); Göran Lindgren, Gävle (SE)

(73) Assignee: Sandvik AB, Sandviken (SE)

( * ) Notice: Subject to any disclaimer, the term of this patent is extended or adjusted under 35 U.S.C. 154(b) by 0 days.

(21) Appl. No.: 09/453,880

(22) Filed: Feb. 11, 2000

(30) Foreign Application Priority Data

Dec. 2, 1999 (SE) ..... 9900458

(51) Int. Cl.[7] ..... B24B 55/02

(52) U.S. Cl. ..... 451/28; 451/54; 451/450; 451/449; 451/342

(58) Field of Search ..... 451/54, 450, 442, 451/448, 449, 342, 270, 548

(56) References Cited

U.S. PATENT DOCUMENTS 1,364,625 A * 1/1921 Eriksen ..... 451/461
5,472,053 A 12/1995 Sullaway et al.
5,637,037 A * 6/1997 Bergquist ..... 451/450
5,639,273 A * 6/1997 Sjolander et al. ..... 451/548
5,688,163 A * 11/1997 Siden ..... 451/342
5,727,994 A 3/1998 Sjolander et al.
5,964,649 A * 10/1999 Bergqvist et al. ..... 451/54
6,056,628 A * 5/2000 Bergqvist et al. ..... 451/548

* cited by examiner

*Primary Examiner*—Lee Wilson
(74) *Attorney, Agent, or Firm*—Burns, Doane, Swecker & Mathis, LLP

(57) ABSTRACT

A grinding tool for grinding buttons of a rock drill bit includes a spindle having a longitudinal axis of rotation, and a grinding cup mounted on the spindle by a tongue-and-socket connection. A fastener in the form of a coil spring secures the grinding cup to the spindle. The grinding cup can be inserted into the inside of, or around the exterior of, the coil spring. When the spindle is rotated in a working direction, the spring tightens against the grinding cup. To install or remove the grinding cup, the grinding cup is rotated relative to the spindle in a direction corresponding to the working direction, whereby engagement between the grinding cup and the coil spring becomes loosened.

2 Claims, 3 Drawing Sheets

10''
27''
14''
13''
16''
15''
11''
32''
36''
37''

10''
10'
27'
16'
37'
15'
11'
32'
14'
36'
13'

10'
10
28
11
27
34
29
13
14
16
37
15
17
D4
31
30
32
33
36
19
18

10
R
20
11
12b
12a
12b
38
12a
12
10

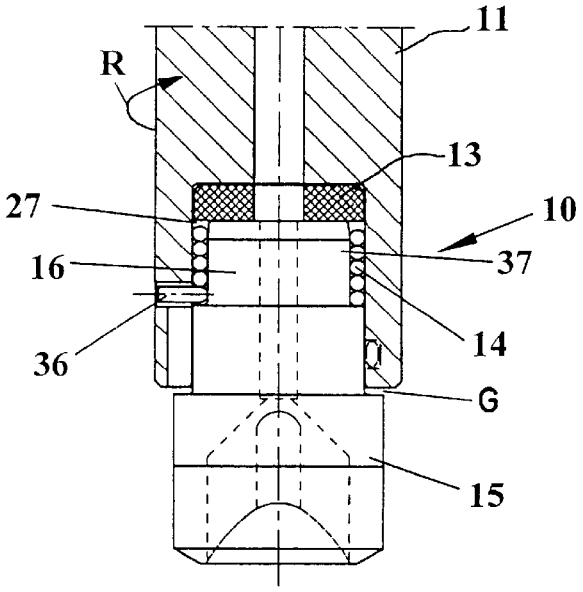
FIG. 1J
FIG. 1G
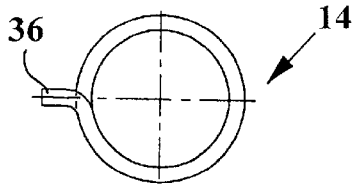
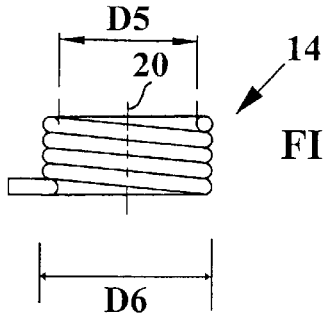
FIG. 1H
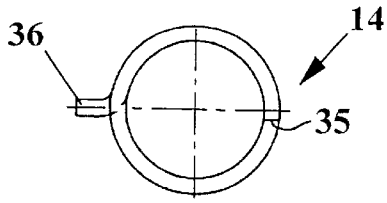
FIG. 1I

GRINDING TOOL FOR GRINDING BUTTONS OF A ROCK DRILL BIT, A GRINDING CUP, A GRINDING SPINDLE AND METHOD FOR MOUNTING THE GRINDING CUP ON A GRINDING SPINDLE

CROSS REFERENCE TO RELATED APPLICATIONS

Not Applicable

STATEMENT REGARDING FEDERALLY SPONSORED RESEARCH

Not Applicable

REFERENCE TO A MICROFICHE APPENDIX

Not Applicable

BACKGROUND OF THE INVENTION

1. Description of Related Art

A conventional grinding tool includes a grinding cup fastened to a rotary spindle, there being a vibration damping device between the spindle and grinding cup.

When grinding cemented carbide buttons of a drill bit, a grinding cup is normally used. The wear part of such grinding cup usually has an abrasive grinding surface that often comprises diamond particles. Grinding of cemented carbide buttons generates both heat and abrasive cuttings to such an extent that it is necessary to cool the grinding cup and the button bit as well as to flush away the cuttings. A prior art means for cooling involves supplying cooling medium, normally water, through the grinding machine and axially through the grinding cup to discharge the cooling medium in the region where the wear part of the grinding cup engages the free end of the button, as is shown in U.S. Pat. No. 5,964,649.

Through for example U.S. Pat. No. 5,688,163, there is previously known a tool for grinding buttons of a rock drill bit. The tool is secured to a grinding head, wherein the rotatably journalled spindle carries a grinding cup. The grinding cup is vibration-damped by means of a bushing of rubber for minimizing the risk for white fingers. Furthermore, the prior art grinding tool comprises means for quickly mounting and dismounting the grinding cup on and from the grinding spindle. Said means comprises an external, movable sleeve, a spring, a ball in a radial hole in the spindle, an O-ring and driving surfaces. This complicates the design of the grinding tool and requires two hands for demounting of the grinding cup.

Through for example U.S. Pat. No. 5,727,994 there is previously known a tool for grinding buttons of a rock drill bit. Also this grinding tool comprises means for quickly mounting and dismounting the grinding cup on and from the grinding spindle. Said means comprises an O-ring that co-operates with a cylindrical surface and polygonal co-operative surfaces for driving. In case a flush medium is supplied to the grinding cup without the grinding cup abutting against a button being ground, the pressure can influence the grinding cup from the inside which overpowers the frictional force between the O-ring and the grinding cup. Thus the grinding cup will become dislodged from the grinding spindle. In addition some skill is needed for aligning the driving surfaces when mounting the grinding cup.

2. Field of the Invention

The present invention relates to a grinding tool for grinding buttons of a rock drill bit, a grinding cup, a grinding spindle and a method for mounting the grinding cup on a grinding spindle.

BRIEF SUMMARY OF THE INVENTION

One object of the present invention is to provide a grinding tool for grinding drill bit buttons, which realizes the advantages of the prior art, Another object of the present invention is to provide a grinding tool that can be mounted or dismantled quickly.

Another object of the present invention is to provide a grinding tool that comprises a minimum of parts.

Another object of the present invention is to provide a grinding tool, which can be mounted or dismounted by means of one hand only.

Another object of the present invention is to provide a grinding tool which is developed such that the grinding cup is retained harder as more torque is applied.

The objects of the present invention are realized by a grinding tool for grinding buttons of a rock drill bit, a grinding cup, a spindle and a method of mounting the grinding cup on a spindle. The grinding tool comprises a spindle having a longitudinal axis of rotation, and a grinding cup mounted on the spindle by a tongue-and-socket connection which includes a cylindrical surface disposed on the grinding cup, the surface being symmetrical with respect to the axis. A vibration damper is disposed between the grinding cup and the spindle. A fastener secures the grinding cup to the spindle. The fastener is attached to the spindle against axial displacement relative thereto. The fastener is arranged to engage the cylindrical surface of the grinding cup to rotate the grinding cup when the spindle is rotated in a working direction. The fastener is arranged to tighten a grip on the grinding cup when the spindle is rotated in the working direction during a grinding operation, and to permit rotation of the grinding head relative to the spindle in the working direction to loosen a grinding head for insertion and removal thereof.

In another aspect of the invention the grinding cup has a body defining an axis of rotation and includes a forward wear part and a rear shank. A flush channel extends through the shank. The shank includes a cylindrical surface arranged symmetrically relative to the axis and defining a sole means of receiving a rotary drive torque during a grinding operation.

In another aspect of the invention an apparatus is provided for holding an insert-grinding cup. The apparatus comprises a grinding spindle which defines an axis of rotation and includes a cylindrical surface at one end thereof adapted to receive a grinding cup. The apparatus also includes a fastener for securing a grinding cup. The fastener is disposed against the cylindrical surface and is attached against axial movement relative to the spindle. The fastener is arranged to permit movement of a grinding cup relative to the spindle in a direction corresponding to a working direction of the spindle.

The invention also pertains a method for mounting a grinding cup on a grinding spindle for grinding buttons of a rock drill bit. The grinding spindle includes a first cylindrical surface. The grinding cup includes a forward wear part and a rear shank having a second cylindrical surface connectable to the first cylindrical surface. A coil spring fastener is provided for interconnecting the first and second cylindrical surfaces. The method comprises the steps of:

A. attaching the coil spring fastener to the grinding spindle such that the fastener is immovable relative thereto in the axial direction;

B. positioning a vibration-damping element between the spindle and the grinding cup; and C. moving the grinding cup axially into engagement with the spindle while rotating the grinding cup relative to the spindle in a direction corresponding to a working direction of the spindle to elastically loosen the coil spring fastener and permit the grinding cup to be axially inserted onto the spindle, wherein step A can be performed prior to, or after, step B.

BRIEF DESCRIPTION OF THE SEVERAL VIEWS OF THE DRAWINGS

Below, three embodiments of a grinding cup according to the present invention will be described, reference being made to the accompanying drawings:

FIGS. 1G–1I show a spring in an end view, in a side view and in an opposite top view, respectively;

FIG. 1J shows the end of the grinding tool according to FIG. 1B in magnification;

DETAILED DESCRIPTION OF THE INVENTION

Figures 1A, 1B, 1C, 2A, 2B, 3A, 3B:
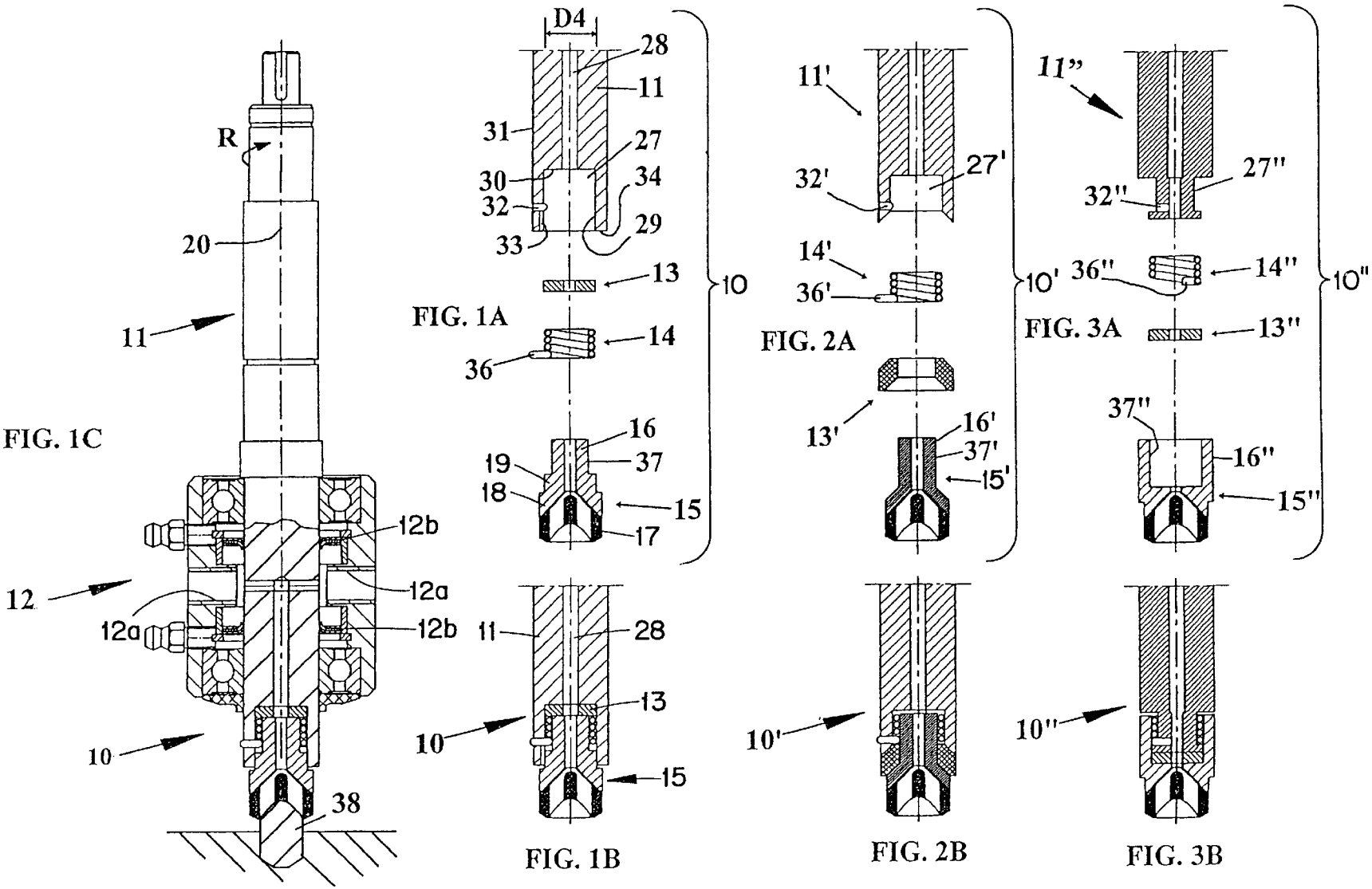
FIG. 1A shows an exploded cross-sectional view of an end of a grinding tool according to the present invention.
FIG. 1B shows the grinding tool of FIG. 1A in a mounted position.
FIG. 1C shows the grinding tool in FIG. 1B mounted to a flushing head.
FIG. 2A shows an exploded cross-sectional view of an end of a grinding tool according to the present invention in an alternative embodiment.
FIG. 2B shows the grinding tool in FIG, 2A in a mounted position.
FIG. 3A shows an exploded cross-sectional view of an end of a grinding tool according to the present invention in an alternative embodiment.
FIG. 3B shows the grinding tool in FIG. 3A in a mounted position.

A first embodiment of a grinding tool 10 according to the present invention for grinding buttons of a rock drill bit is described hereinafter with reference to FIGS. 1A–1J. The tool comprises a grinding spindle 11, a vibration-damping means 13, a mounting means or a spring 14 and a grinding cup 15. In FIG. 1C the tool 10 is shown as mounted to a swivel or flushing head 12 to form a grinding assembly.

The upper end of the grinding spindle 11 is intended to be rotatably mounted in a grinding head, not shown, of the type shown and described in EP-B-734,306, which hereby is incorporated by reference into the description. The grinding head is thus connected to a power source such as an electric motor and can be vertically displaced, i.e. downwardly and upwardly. The grinding head comprises an external housing (not shown) which is stationary. The grinding spindle 11 is rotatably journalled in a boring of the spindle house by means of roller bearings that are spaced apart axially in the longitudinal direction of the grinding spindle. The end of the grinding spindle that projects from the external housing carries the flushing head 12. The flushing head 12 is provided with one or several openings 12*a* which are intended to receive hoses that conduct flush medium from a suitable source. The connection of the hoses to the source prevents a part of the frequently made from hard metal, and the recess 22 is therefore provided with an abrasive material, preferably diamonds in a binder matrix. If the wear part 17 is of one piece with the first intermediate portion 18, i.e., if the wear part blank is made of steel, it can be suitable by electroplating or in some other suitable manner, to apply a diamond layer to the wear part blank symmetrical about the rotational axis 20 and comprises a cylindrical wall 29 and a bottom surface 30. The recess 27 has a diameter D4. The bottom surface 30 is substantially planar and perpendicular to the axis 20. A radially extending hole 32 extends through the wall 30 and intersects the jacket surface 31 of the spindle. An axial groove 33 extends from the hole axially forwards along the wall 29 and forwards to the free end surface 34 of the spindle 11. The spindle may eventually include a circumferential groove in the surface 29 to receive an O-ring for radial vibrational damping, depicted at right in FIG. 1J.

The vibration-damping means comprises a circular washer 13 made of plastics or rubber. The washer has two plane-parallel side faces and a central hole. The spring 14, which is primarily shown in FIGS. 1G–1I, is a helical coil spring made from a tightly wound, preferably stainless steel wire of about 1 mm diameter. The spring 14 has, in the shown embodiment, about 4.5 left-wound turns and its ends 35, 36 have mutually different appearances. One end 35 lies within an imaginary cylindrical tube, which is formed by the spring, while its other end 36 projects outside of said tube, perpendicularly to the axis 20. The spring shall, as seen from the other end 36, be wound opposed to the direction R in which the spindle will rotate during grinding. The spring has an inner diameter D5, for example 11 mm, and an external diameter D6.

Figure 1D:
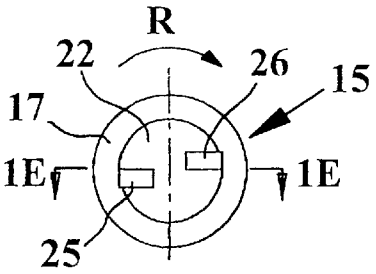
FIGS. 1D–1F show the grinding cup according to FIG. 1A in an end view, in a cross-section (section 1E—1E in FIG. 1D) and in an opposite top view, respectively.
Figure 1E:
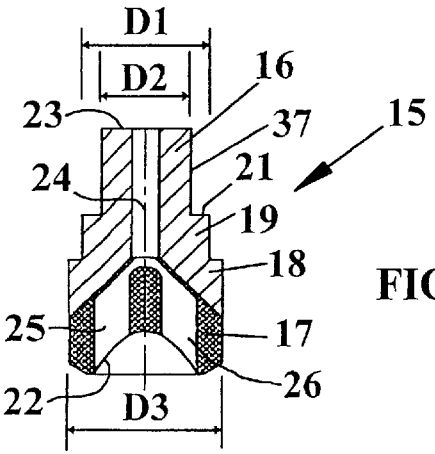
Figure 1F:
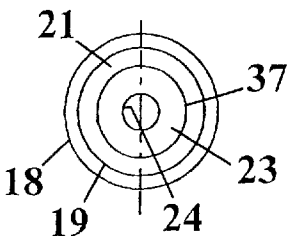
Figure 2C:
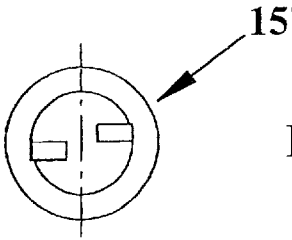
FIGS. 2C–2E show the grinding cup according to FIG. 2A in an end view, in a cross-section and in an opposite top view, respectively.
Figure 2D:
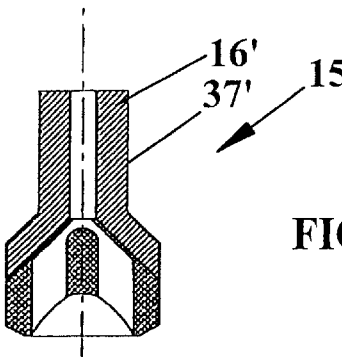
Figure 2E:
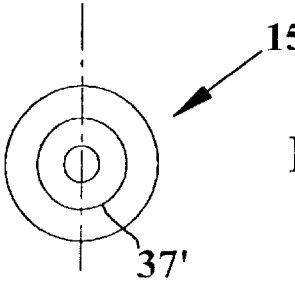
Figure 3C:
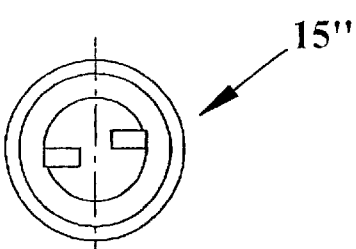
FIGS. 3C–3E show the grinding cup according to FIG. 3A in an end view, in a cross-section and in an opposite top view, respectively.
Figure 3D:
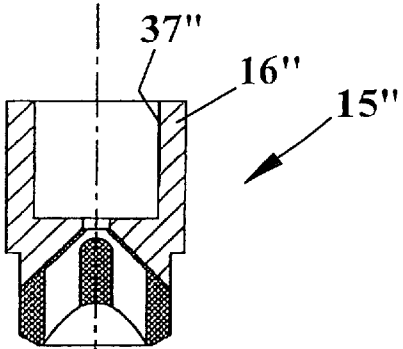
Figure 3E:
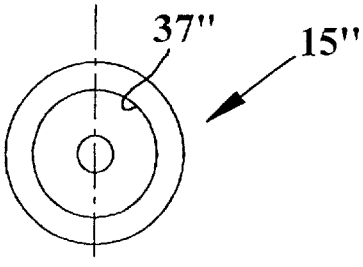

The grinding cup 15 according to the present invention, see primarily FIGS. 1D–1F, comprises a shank 16, a wear part 17, and first and second intermediate portions 18, 19 which connect the shank 16 to the wear part 17. The shank and the recess 27 together define a tongue-and-socket connection between the grinding cup 15 and the spindle 11. All segments 16–19 are cylindrical without having any driving grooves and have a substantially similar axial extension. Preferably, the shank 16 and the intermediate portions 18, 19 are made as a one-piece unit. The shank 16 comprises a cylindrical shank surface 37 which preferably via an entering bevel connects to a planar rear surface 23, which is substantially perpendicular to the axis 20 and which is intersected by a preferably central flush channel 24. The wear part 17 is connected to the first intermediate portion 18 in a suitable manner, preferably by direct sintering or by brazing via conical surfaces, which facilitates the jointing method. Within the scope of the present invention it is also possible for the wear part 17 to be made as a one-piece unit with the first intermediate portion 18. The grinding cup 15 is symmetrical relative to its longitudinal central or rotational axis 20, and therefore the cup may be used both for right-hand and left-hand grinding.

The shank 16 has a diameter DI; the second intermediate portion 19 has a diameter D2; and the first intermediate portion 18 and the wear part 17 have a diameter D3. The diameters fulfill the following condition: D2<D1<D3. Alternatively D3 can be less than D2. A shoulder 21 is formed at a transition between the shank 16 and the second intermediate portion 19. The shoulder 21 is planar and substantially perpendicular to the axis 20.

The forward end of the wear part 15 has a recess 22 in the shape of a ballistic segment when the buttons have ballistic free ends. However, if the buttons have conical or spherical free ends then the recess of course has a corresponding shape. The recess 22 is intended to be in engagement with, and cooperate with, the free end of the button being ground. The button is frequently made from hard metal, and the recess 22 is therefore provided with an abrasive material, preferably diamonds in a binder matrix. If the wear part 15 is of one piece with the first intermediate portion 18, i.e., if the wear part blank is made of steel, it can be suitable by electroplating or in some other suitable manner, to apply a diamond layer to the wear part blank.

The wear part 15 has two flush channels 25, 26 extending axially parallel with and spaced from the axis 20. Each flush channel 25, 26 extends axially forwardly from the rear side of the wear part, and terminates at least in the recess. Preferably, the channel 25, 26 also terminates at a portion radially outside of the recess 22. Each channel 25, 26 has a rectangular basic cross sectional shape, the short sides of which are substantially parallel with the central axis 20 and the long sides of which are parallel to each other. An imaginary extension line of one long side of each channel does not intersect the opposite channel, i.e., the channels are not diametrically aligned with one another. The radially inner end of each channel is radially spaced from the central axis. Through this design of the grinding cup, the buttons can be ground without leaving a "wart" or projection on the top of the button, which diminishes the risk for the button breaking prematurely during drilling. In addition, a constant flow of flush medium is obtained, since the channels 25, 26 can not be clogged by grinding residues during the grinding process.

The described grinding tool 10 functions in the following manner with reference primarily to FIG. 1J, wherein it is understood that the grinding spindle 11 and the swivel 12 already have been assembled to each other and to the grinding head. The washer 13 is pushed into the recess 27 of the spindle such that it abuts against the bottom surface 30 of the recess. Then the spring 14 is pushed into the recess such that the end 35 of the spring first enters and then the other end 36 of the spring is elastically pushed radially inwards for entering the groove 33. The groove guides the end 36 such that it will rebound (snap) into the hole 32 after further transport of the spring into the recess. Through co-operation between the end 36 and the hole 32, both the washer and the spring are secured from falling out from the recess.

The outer diameter D6 of the spring is dimensioned somewhat less than the diameter D4 of the recess 27. Then the grinding cup is aligned with the axis 20 such that the shank 16, with a diameter for example of 11.5 mm, can be inserted towards the spring 14. About simultaneously as the free end of the shank abuts against the axially forward part of the spring also the second intermediate portion 19 of the cup engages the wall 29 of the recess. That is, the diameter D1 is about the same as the diameter D4 to achieve a slide fit. By further pushing the grinding cup inwardly, the shank will enter the spring and, due to the difference in diameter of about 0.5 mm between D2 and D5, the spring is adapted to the diameter of the shank and therefore the grinding cup can be pushed into the recess until the end surface 23 of the cup abuts against the bottom surface 30. In that position there is always a gap G between the end surface 34 and the grinding cup such that vibrations shall be extinct in the washer.

To further facilitate the mounting and to diminish the strain on the spring, the cup is rotated, at least less than a half turn, during insertion of the shank into the spring. The cup is then rotated in a direction opposite the winding of the spring for increasing the diameter D5 of the spring and the insertion becomes easy. If the cup is rotated in the same direction as the windings of the spring, the spring will squeeze the shank such that insertion cannot be done. This phenomena is completely dependent on one end of the spring being free and the other end being secured from rotation such that the friction between the spring and the shank increases or diminishes depending on the rotational direction. The phenomenon is then used for driving the grinding cup during grinding. The direction of winding of the spring decides in which direction the tool drives the grinding cup. Although the embodiment shows a left-wound screw spring, right-wound springs will be frequently used.

By axially securing the axial forward end 36 of the spring in the hole 32, plastic deformation of the spring is counteracted during loosening of the cup, since the pitch can not be increased due to the thread windings in the spring abutting against each other at pure retraction without rotating the grinding cup. The grinding cup is then adjusted in a position relative to the button which is to be ground, that is in a position where the wear part 17 is in engagement with the button 38, FIG. 1C. The grinding cup 15 is then rotated in the working direction R to perform grinding of the button. The friction between the shank 16 and the spring is increased by acceleration of the spindle. By flushing through the grinding tool, the cup 10 cannot disengage in spite of the lack of axial support from the button because the spring will be somewhat tilted in the recess 27 and thereby wedge up the shank. At provoked tests with the spring soaked with oil or soap, the cup has not been able to be drawn loose without the aid of the above described relative rotation. The grinding cup can be mounted and dismounted with only one hand.

During loosening of the grinding cup, the procedure for mounting is substantially reversed except that the cup is relative-rotated in the same direction as when being mounted. The spring and the washer will remain in the recess until they have been worn and must be exchanged.

FIGS. 2A–2F, show an alternative embodiment of a grinding tool 10' according to the present invention with indexed reference numerals in accordance with the above-captioned embodiment. This embodiment differs from the above-described embodiment foremost in that the grinding cup 15' is guided via conical cooperating surfaces on the clip, the washer 13' and the grinding spindle 11'. The washer 13' minimizes the transfer of vibrations from the grinding cup to the grinding spindle in connection with the grinding of the drill bit button, and it efficiently seals such that abrasive material does not enter into the recess.

The spring becomes expanded in the two previously described embodiments of FIGS. 1A–1I and 2A–2E for holding the grinding cup, while the spring in the next embodiment (FIGS. 3A–3E) functions by contraction for holding the grinding cup.

That is, FIGS. 3A–3E show an alternative embodiment of a grinding tool 10" according to the present invention. This embodiment differs from the above-described first embodiment of FIGS. 1A–1I foremost in that the shank 16" of the grinding cup 15" comprises a central recess 37" intended to receive both the washer 13" and the projecting free end of the grinding spindle 11". Said free end or projection carries the spring 14", the axial forward end 36" of which faces radially inwardly for co-operation with a hole 32" in the spindle 11". The embodiment is primarily intended for grinding smaller buttons where the space around the hard metal button is limited by adjacent buttons, wherein the coupling between the cup and the spindle can be arranged regardless of the dimension of the grinding end.

Thus, the present invention relates to a grinding tool for grinding buttons of a rock drill bit, a grinding cup, a spindle and a method for mounting the grinding cup on a spindle, wherein a plurality of advantages in relation to prior art can be mentioned. For example, the grinding tool can be mounted or dismounted quickly with a minimum of parts and with a few simple manual operations; the tool can be mounted or be dismounted with only one hand; and the tool is made such that the grinding cup shank is held more firmly as larger torque is applied onto the grinding cup.

DEPOSIT OF COMPUTER PROGRAM LISTINGS

Not Applicable

What is claimed:

1. A grinding cup for grinding buttons of a rock drill bit, the grinding cup having a body defining an axis of rotation and including a forward wear part and rear shank, the wear part including a forwardly open concave recess containing abrasives, a flush channel extending through the shank and opening into the concave recess, the shank including a cylindrical friction surface arranged symmetrically relative to the axis for receiving a frictional rotary drive torque, defining a sole means of rotationally driving the grinding cup during a grinding operation.

2. The grinding cup according to claim 1 wherein the body further comprises an intermediate portion which connects the shank to the wear part, the wear part including flush channels oriented eccentrically relative to the axis and communicating with the flush channel that extends through the shank.

* * * * *